United States Patent [19]

Nakamura

[11] Patent Number: 4,671,200

[45] Date of Patent: Jun. 9, 1987

[54] SAIL FURLING APPARATUS

[75] Inventor: Masakazu Nakamura, Yokohama, Japan

[73] Assignee: Nakamura Sengu Kogyo K.K., Yokohama, Japan

[21] Appl. No.: 832,933

[22] Filed: Feb. 24, 1986

[30] Foreign Application Priority Data

May 27, 1985 [JP] Japan ..... 60-77749[U]

[51] Int. Cl.[4] ..... B63H 9/10

[52] U.S. Cl. ..... 114/106; 114/107

[58] Field of Search ..... 114/90, 92–96, 114/100–102, 104–108

[56] References Cited

U.S. PATENT DOCUMENTS 3,964,419 6/1976 Uecker ..... 114/106

4,248,281 2/1981 Hood ..... 114/106

FOREIGN PATENT DOCUMENTS 2551722 3/1985 France ..... 114/106

*Primary Examiner*—Sherman D. Basinger

*Attorney, Agent, or Firm*—Jordan and Hamburg

[57] ABSTRACT

An apparatus for furling a sail on a sailboat having a mast includes a stay extending between the deck and the mast on the sailboat, a hollow shaft loosely fitted over the stay and supporting the side edge of the sail, the hollow shaft being rotatable about the stay such that the sail can be wound and unwound about the hollow shaft, at least one ring member disposed around the shaft and having an opening which permits the sail to move onto the shaft therethrough, and wire ropes extending between the deck and mast on the sailboat and supporting the ring member about the shaft.

16 Claims, 8 Drawing Figures

SAIL FURLING APPARATUS

BACKGROUND OF THE INVENTION

1. Field of the Invention

The present invention relates to an improvement of a sail furling apparatus including a sail furling shaft.

2. Description of The Prior Art

There generally is known a sail furling apparatus as shown in FIGS. 7 and 8 of the accompany drawings.

A sailboat comprises a hull 1, a deck 2, a vertical mast 3 extending upwardly from the deck 2, and a stay 4 connected at one end with the bow end of the hull 1 through an anchoring member 4*a*. The stay 4 extends slantwise from the bow end of the hull 1 toward the top of the mast 3 and then passes through guide means 11A on the top of the mast 3. The stay 4 then extends downwardly from the guide means 11A to another guide means 11B along the mast 3 and from the guide means 11B into a locking device 12 on the stern of the hull 1. In the locking device 12, the other end of the stay 4 is releasably locked to hold its slant position as shown in FIG. 7.

A sail furling shaft 5 of hollow configuration is loosely fitted over th stay 4, as seen best from FIG. 8. The sail furling shaft 5 is provided with a longitudinal slot 6 which receives the folded-back side edge 7A of a triangular sail 7. The sail furling shaft 5 also includes a winding sleeve 9 formed thereon at the bottom end and with which a furling rope 10 is connected at one end. The furling rope 10 extends from the winding sleeve 9 through a further guide means 11C to the locking device 12 on the stern of the hull 1. When the furling rope 10 is pulled in the direction shown by A in FIG. 7, the winding sleeve 9 and thus the sail furling shaft 5 can be rotated to wind the sail 7 therearound. The other end of the furling rope 10 can releasably be locked by the locking device 12.

The apex 7B of the triangular sail 7 is connected with a tensioning rope 8 which extends from the sail apex 7B through the guide means 11B to to the locking device 12. The other end of the tensioning rope 8 can also releasably be locked by the locking device 12.

When the sail 7 has been wound around the sail furling shaft 5 and when the furling rope 10 is unlocked and loosened at the locking device 12, the tensioning rope 8 can be pulled in the direction A to unwind the sail 7 from the sail furling shaft 5 into its deployed position. Thereafter, the furling rope 10 can be locked by the locking device 12 to hold the sail 7 in its deployed position.

When it is desired to wind the sail 7 around the sail furling shaft 5, the tensioning rope 8 is unlocked and loosened at the locking device 12. The furling rope 10 is then pulled in the direction A to rotate the sail furling shaft 5 such that the sail 7 will be wound therearound. Thereafter, the furling rope 10 can be locked by the locking device 12.

When the stay 4 is unlocked and loosened at the locking device 12, the sail furling shaft 5 can be moved to its horizontal position under the action of gravity.

The sail furling shaft 5 may be distorted by its own weight or by a strong wind. Such a distortion can be avoided by the use of a sail furling shaft having an increased diameter. However, this is undesirable in that the sail furling shaft has increased weight.

SUMMARY OF THE INVENTION

It is therefore an object of the present invention to provide a sail furling apparatus comprising a sail furling shaft which is of relatively light weight and which avoids distortion.

To achieve the above object, the present invention provides an apparatus for furling a sail in a sailboat having a mast, comprising a stay extending between the deck and mast on the sailboat, hollow shaft means loosely fitted over the stay and supporting the side edge of the sail, the hollow shaft means being adapted to rotate about the stay such that the sail can be wound and unwound about the hollow shaft means, at least one ring member disposed around the shaft means intermediate the opposite ends thereof and having an opening which permits the sail to pass to the shaft means therethrough, and rope means extending between the deck and mast on the sailboat and supporting the ring member in position about the shaft means.

In a preferred embodiment, two ring members are used and the rope means includes two groups of ropes each of which ropes is connected at one end with one of the ring members and at the other end with the deck or mast on the sailboat.

DETAILED DESCRIPTION OF THE PREFERRED EMBODIMENTS

Figure 7:
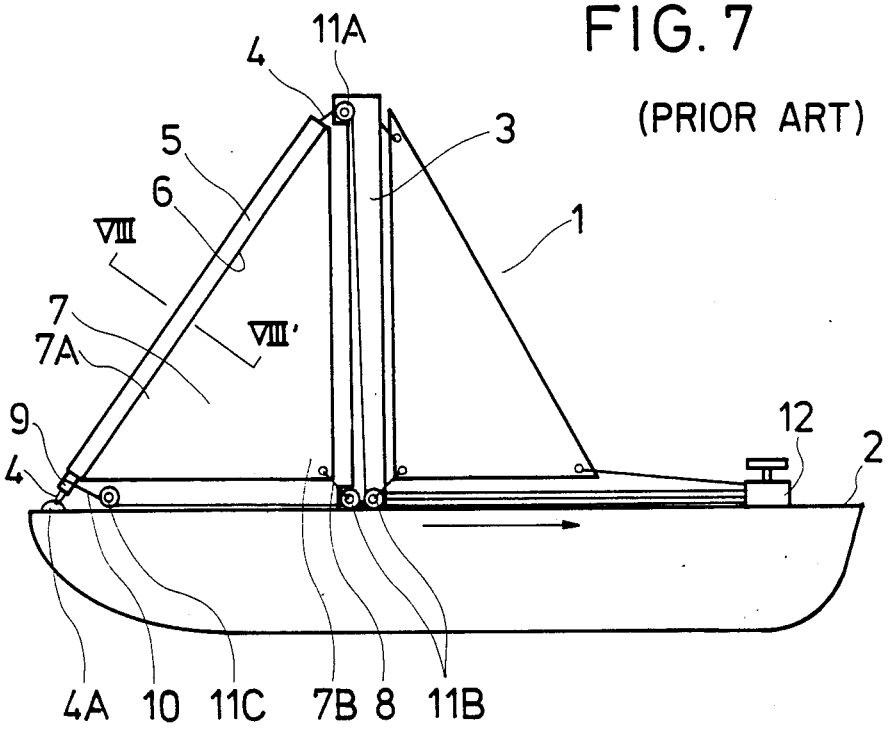
FIG. 7 (PRIOR ART)
FIG. 7 is a side view of a sailboat having a sail furling apparatus known in the prior art.

In FIGS. 1 through 6, parts similar to those in the sailboat shown in FIG. 7 are denoted by similar reference numerals and will not further be described hereinafter.

Figure 1:
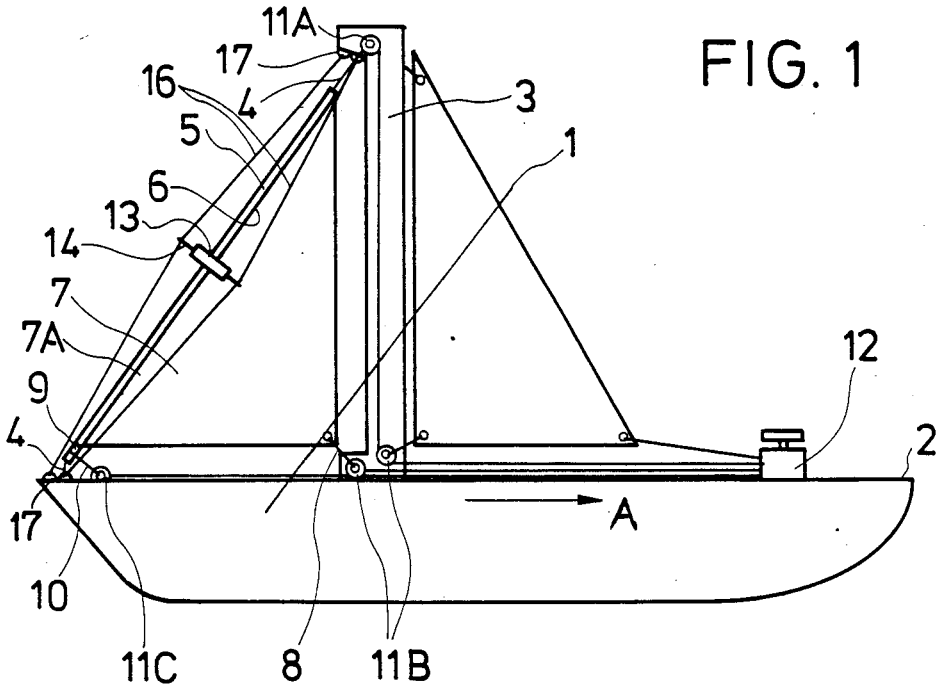
FIG. 1 is a side view of a sailboat showing one embodiment of a sail furling apparatus according to the present invention.
Figure 2:
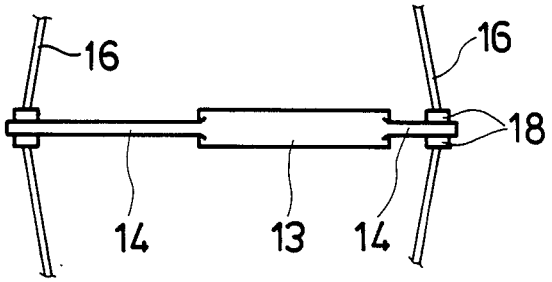
FIG. 2 is a fragmentary side view, in an enlarged scale, of the sail furling apparatus shown in FIG. 1.
Figure 3:
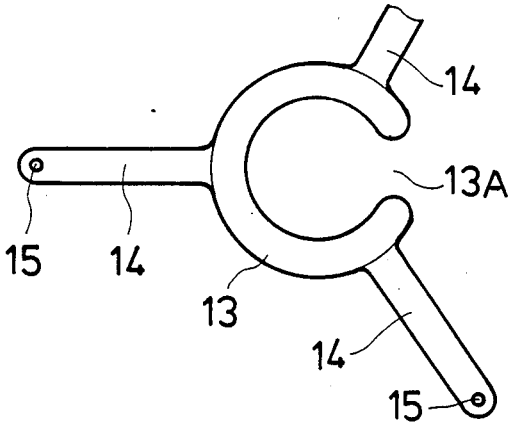
FIG. 3 is a plan view of FIG. 2.

Referring to FIGS. 1 to 3, there is shown a sail furling apparatus comprising a ring member 13 disposed about the sail furling shaft 5 and having an internal diameter substantially larger than the external diameter of the sail furling shaft 5. The ring member 13 is fixedly supported about the sail furling shaft 5 intermediate the opposite ends therof by means of wire ropes 16 each of which is connected at one end with the bow end of the hull through a fitting 17. The other end of the wire rope 16 is fastened to the top of the mast 3 through another fitting 17. Each of the wire ropes 16 extends through an eyelet 15 in the free end of each of arms 14 which extend outwardly and radially from the outer periphery of the ring member 13 and are circumferentially spaced equidistantly from one another. Each of the wire ropes 16 is fixed relative to the free end of the corresponding arm 14 on the ring member 13 by means of stop rings 18.

Figure 8:
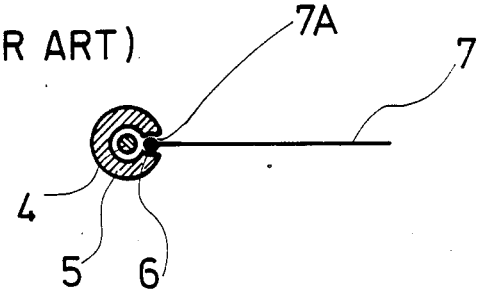
FIG. 8 (PRIOR ART)
FIG. 8 is a cross-sectional view taken along a line VIII—VIII in FIG. 7.

The ring member 13 is provided with an opening 13*a* through which the sail 7 can reach the longitudinal slot 6 in the the furling shaft 5 (see FIG. 8). Therefore, the sail 7 can freely be wound and unwound about the sail furling shaft 5 in spite of the presence of the ring member 13.

Since the ring member 13 is firmly supported by the wire ropes 16 extending between the deck 2 and the mast 3, the sail furling shaft 5 or the sail 7 wound thereabout can be contacted and rigidly supported by the ring member 13 even if any bending moment is applied to the sail furling shaft 5 from the tensioning rope 8 and/or the winding rope 10 or by the weight of the shaft 5, sail 7 and stay 4. In such a manner, the sail furling shaft 5 can be prevented from distorting. Therefore, the sail furling apparatus can utilize a sail furling shaft having a decreased weight.

Figure 4:
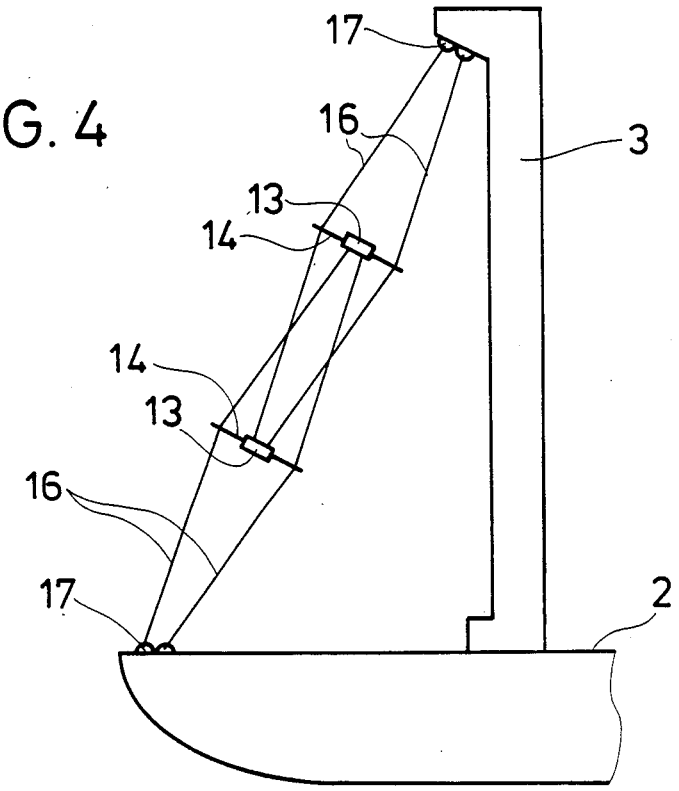
FIG. 4 is a schematic view of another embodiment of the sail furling apparatus according to the present invention.
Figure 5:
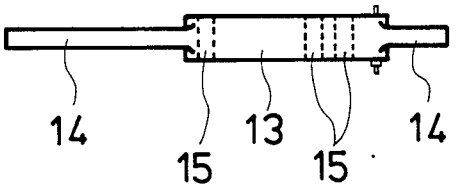
FIG. 5 is a fragmentary side view, in an enlarged scale, of the sail furling apparatus shown in FIG. 4.
Figure 6:
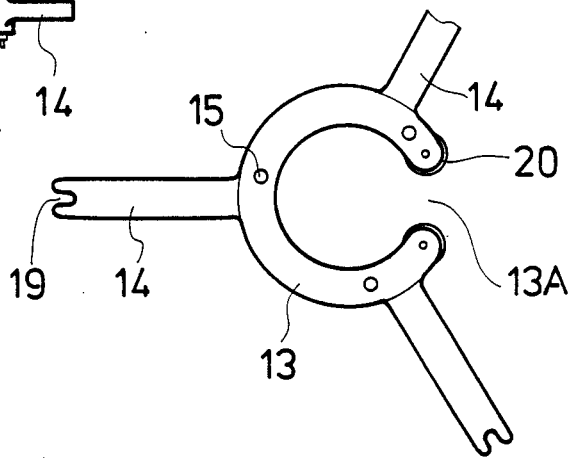
FIG. 6 is a plan view of FIG. 5.

FIG. 4 shows another embodiment of the present invention in which two ring members 13 are used. Each of the ring members 13 is provided with a plurality of similar arms 14 extending radially from the outer periphery thereof. The free end of each of the arms 14 is provided with a notch 19 instead of the eyelet. The notch 19 similarly supports the corresponding wire rope 16 through a stop ring (not shown). An eyelet 15 is formed in the ring member 13 between each adjacent arms 14.

The ring members 13 are fixedly supported by two groups of wire ropes 16. Each of the wire ropes 16 in each group is fastened at one end to one eyelet 15 in the corresponding ring member 13. The other ends of the wire ropes 16 supporting the lower ring member 13 are connected with the top of the mast 3 through fittings 17 while the other ends of the wire ropes 16 supporting the upper ring member 13 are fastened to the bow end of the hull through fittings 17.

Each of the ring members 13 is preferably provided with rollers 20 at the opening 13*a* such that the sail 7 can smoothly be guided onto the sail furling shaft 5.

It is also preferred that each of the ring members 13 is made of any suitable light metal since the entire apparatus can be decreased in weight.

We claim:

1. Sail furling apparatus for use on a sailboat having a mast and a stay extending between the deck and the upper end of the mast, comprising an elongated hollow shaft means rotatably carried on said stay, said shaft means having sail attachment means for attaching the edge of a sail to said shaft means such that rotation of said shaft means about said stay will cause said sail to furl about said shaft means, a ring means disposed about and spaced from said shaft means such that the furled sail is disposed in the space between said shaft means and said ring means, said ring means having an opening through which said sail extends as the sail is being furled and unfurled, and longitudinally extending ring-support means extending between said ring means and said deck and between said ring means and an upper part of said mast to support said ring means in a fixed position about said shaft means such that the ring means thereby provides support against lateral distortion of said shaft means.

2. Sail furling appartus according to claim 1, wherein said longitudinally extending ring-support means comprise wire ropes.

3. Sail furling apparatus according to claim 2, wherein there are at least three of said wire ropes extending between said deck and said upper part of said mast, and connecting means connecting each of said at least three wire ropes to said ring means.

4. Sail furling apparatus according to claim 2, wherein said ring means is supported solely by said wire ropes at a generally mid-position of the longitudinal length of said shaft means.

5. Sail furling apparatus according to claim 1, wherein said ring means comprises a rigid ring member having an inner diameter greater than the outer diameter of said shaft means so as to accommodate the entire furled sail within the annular space between said shaft means and said ring member.

6. Sail furling apparatus according to claim 5, wherein said ring member has said opening therein such that the ring member has a generally C-shaped configuration.

7. Sail furling apparatus according to claim 5, wherein said ring means further comprises lateral support parts extending outwardly from said ring member, and fixing means fixing said longitudinally extending ring-support means to said lateral support parts.

8. Sail furling apparatus according to claim 7, wherein said lateral support parts are elongated arms which extend generally radially outwardly from said ring member.

9. Sail furling apparatus according to claim 1 further comprising roller means mounted on said ring means on each side of said opening.

10. Sail furling apparatus according to claim 1, wherein said ring means comprises a single ring member disposed generally midway of the longitudinal length of said shaft means.

11. Sail furling apparatus according to claim 1, wherein said ring means comprises at least two ring members each spaced generally one-third of the way along the longitudinal length of said shaft means.

12. Sail furling apparatus according to claim 1 further comprising a second ring means disposed about and spaced from said shaft means such that the furled sail is disposed in the space between said shaft means and said second ring means, said second ring means being spaced from the first said ring means, said second ring means having an opening through which said sail extends as the sail is being furled and unfurled, said longitudinally extending ring-support means extending to said second ring means to thereby support both the first said ring means and said second ring means in fixed positions about said shaft means such that both the first said ring means and said second ring means thereby provide support against lateral distortion of said shaft means.

13. Sail furling apparatus according to claim 12, wherein said longitudinally extending ring-support means comprises first wire ropes connected to the two ring means and said deck and second wire ropes connected to the two ring means and the upper part of said mast.

14. Sail furling apparatus according to claim 13, wherein the first said ring means comprises a first ring and a first plurality of arms extending radially from said first ring, said second ring means comprising a second ring and a second plurality of arms extending radially from said second ring, said first wire ropes having one end thereof connected to the first ring, the other end thereof connected to said deck, and an intermediate part thereof connected to the second plurality of arms, said second wire means having one end thereof connected to the second ring, the other end thereof connected to the upper part of said mast, and an intermediate part thereof connected to the first plurality of arms.

15. Jib sail furling apparatus for use on a sailboat having a mast and a stay extending between the deck at the bow of the sailboat and the upper end of the mast, comprising an elongated hollow shaft means rotatably carried on said stay, said shaft means having sail attachment means for attaching a sail to said shaft means such that rotation of said shaft means about said stay will cause said sail to furl about said shaft means, ring means disposed about and spaced from said shaft means such that the furled sail is disposed in the space between said shaft means and said ring means, said ring means having an opening through which said sail extends as the sail is being furled and unfurled, and wire ropes extending between said ring means and said deck at the bow of the sailboat and between said ring means and said upper end of said mast to support said ring means in a fixed position about said shaft means such that the ring means thereby provides support against lateral distortion of said shaft means.

16. Jib sail furling apparatus for use on a sailboat having a mast and a stay extending between the deck at the bow of the sailboat and the upper end of the mast, comprising an elongated hollow shaft means rotatably carried on said stay, said shaft means having sail attachment means for attaching said sail to said shaft means such that rotation of said shaft means about said stay will cause said sail to furl about said shaft means, a ring means disposed about and spaced from said shaft means such that the furled said is disposed in the space between said shaft means and said ring means, said ring means having an opening through which said sail extends as the sail is being furled and unfurled, and a plurality of wire ropes substantially equally spaced about said shaft means and extending between said ring means and said deck at the bow of the sailboat and between said ring means and the upper end of said mast to provide the sole support for said ring means in a fixed position about said shaft means such that the ring means supported by said wire rope prevents lateral distortion of said shaft means.

* * * * *